US006042117A

United States Patent [19]

O'Brien

[11] Patent Number: 6,042,117

[45] Date of Patent: Mar. 28, 2000

[54] GAME BOARD USING TWO-POSITION INDICATORS

[76] Inventor: Dennis J O'Brien, P.O. Box 21142, West Palm Beach, Fla. 33416

[21] Appl. No.: 09/069,005

[22] Filed: Apr. 28, 1998

[51] Int. Cl.[7] ..... A63F 3/00

[52] U.S. Cl. ..... 273/281; 273/287; 273/236

[58] Field of Search ..... 273/236, 240, 273/260, 263, 264, 270, 271, 281, 287, 288

[56] References Cited

U.S. PATENT DOCUMENTS

| | | |
|---|---|---|
| 245,873 | 8/1881 | Sargent . |
| 2,103,916 | 12/1937 | Robinson . |
| 3,128,098 | 4/1964 | Kolenda . |
| 3,266,724 | 8/1966 | Johnson . |
| 3,779,553 | 12/1973 | Secter . |
| 3,891,219 | 6/1975 | Foerst . |
| 4,513,973 | 4/1985 | Sinclair . |
| 4,805,915 | 2/1989 | Lamle . |
| 5,573,245 | 11/1996 | Weiner et al. . |
| 5,743,796 | 4/1998 | Orak . |

*Primary Examiner*—William M. Pierce
*Attorney, Agent, or Firm*—A. David Pellinen

[57] ABSTRACT

A game board has playing pieces. In the form of indicators which are permanently attached to a game board base. A push button approach that simulates the play of well known games is used to effectively move pieces around a game board. The indicators are push buttons that can occupy either of two positions. In the up position the indicator could represent the presence of a piece or player, or that a particular location or region is occupied. The number of push buttons use will depend on the game and its rules. There could be one, two or four push buttons for each region. One push button could simulate the golf tees of a peg board game. Two buttons could be used to simulate a tic-tac-toe game, while four push buttons could simulate a checkers type game. The permanence of the indicators means that pieces cannot be lost.

12 Claims, 8 Drawing Sheets

FIG.5

GAME BOARD USING TWO-POSITION INDICATORS

BACKGROUND OF THE INVENTION

1. Field of the Invention

The present invention relates to improvements in toys or games, particularly games wherein the strategy involved causes pegs, pieces, or other indicators to be moved, shifted, or otherwise displaced from one position to another. The improvement is in the provision of a new indicator or piece that is never physically removed or lifted off the playing surface.

2. Description of the Prior Art

Games often involve moving a peg or piece from one location to another. For example, in checkers there are commonly red and black colored pieces that are moved around the game board or lifted off the board. These checker pieces can be placed onto another piece when a piece is "kinged".

Backgammon is another game where pieces are moved around the board from one spot or location to another depending on the roll of dice.

Some games involve removing a golf tee from one location and placing it in another location, while removing a golf tee from the board.

Numerous other games exist that require the movement and/or the removal of a playing piece. What is common with these games is the frequent movement of pieces. As a game progresses the pieces are moved or removed as the rules of the game dictate. The pieces might unintentionally be moved further, particularly when children play, or when the game is played in a moving car or other vehicle. When removed from the board they tend to be put somewhere haphazardly, with the possible result they are momentarily, or worse, permanently lost. Finally, even when putting the pieces away they are frequently lost. As is evident each of these simple events presents the possibility of confusion in the game or a loss of pieces.

The problem of losing pieces has long been recognized. In U.S. Pat. No. 2,103,916, issued on Dec. 28, 1937 to F. H. Robinson, a cribbage scoring device has depressible keys. A system of plungers, levers, and oscillating plates are used and another key is used as a clearing key to restore the keys to an original position.

U.S. Pat. No. 3,891,219, issued on Jun. 24, 1975 to Foerst, has pins protruding through bores that can be pushed or pulled and which are in frictional engagement with the bores. Both patentees avoid the loss of pieces as their keys and pins always remain on the board.

SUMMARY OF THE INVENTION

The present invention uses a push button approach to simulate the play of well known playing games utilizing a two position indicator or playing piece. The game board surface itself can be considered a single region and the surface is effectively further divided into a plurality of regions, areas or locations. There are a plurality of indicators on the playing surface each of which is capable of being in an upper or lower position. There may be a single indicator or playing piece on a region, area or location or there may be more than one indicator on a region, area or location. The indicator is capable of being in either of two positions. The first position is one in which the indicator extends from the top surface of the game board to an upper position; the second position is a lower position than when in the upper position. The lower position may be one in which the top of the indicator is flush with the game surface, or it may be slightly higher that the game surface, but still enough to readily distinguish the positions by merely observing them.

The indicator is the kind that is depressible whether it is in the upper or lower position. When in the upper position the indicator can be depressed to attain the lower position, and when in the lower position can be depressed to attain the upper position. Thus no separate clearing key or the pulling of an indicator is required, nor does the board need to be turned over to exert a restoring effect.

The top surface may be lined to divide the surface into a plurality of regions, areas or locations. When lined the entire surface region can replicate the appearance of a checkerboard. The number of regions can comport to the game being simulated thus giving the appearance of the identical game, and indeed the same game can be played using the same rules. Alternatively the surface need not be lined. The use of different colors with the indicators is advantageous in that no dividing lines are needed; the very appearance of the board surface with its indicators can duplicate, for example, the appearance of a checkers game and its common checkerboard appearance.

The game board surface may be square, rectangular, triangular, octagonal, or any other shape. The surface may duplicate the triangular shape of a well known game using golf tees.

The game board itself is preferably made of plastic but any suitable material may be used. The size of game board is a matter of choice; it can be made small enough to be put in one's picket, and with a key chain attached to the base or a side surface, is easily pocketed.

DETAILED DESCRIPTION OF THE INVENTION

The accompanying drawings are not drawn to scale in order to facilitate an understanding of the invention.

Figure 1:
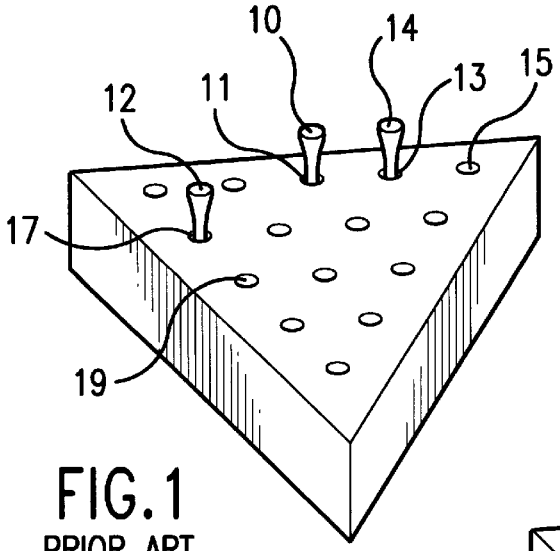
FIG.1 PRIOR ART
FIG. 1 shows a prior art game using removable pieces.
Figure 2:
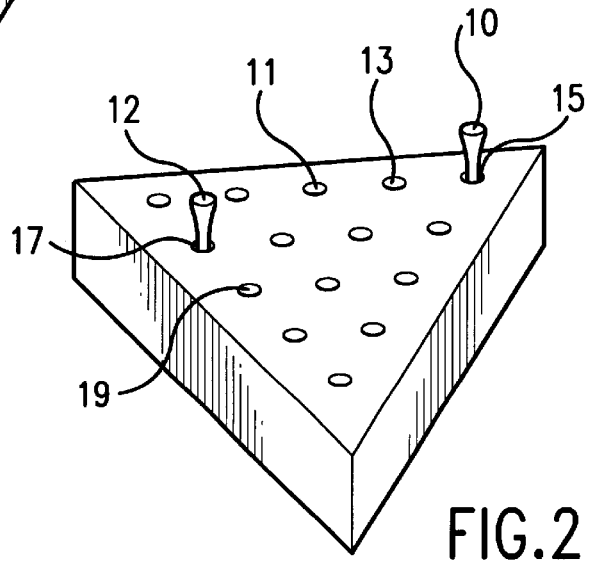
FIG.2 PRIOR ART
FIG. 2 shows the prior art game of FIG. 1 after one move has been made.

Reference is made to Prior Art FIGS. 1–4 to set forth the problem the invention solves. FIGS. 1 and 2 are perspective views showing a typical board game involving removable pegs. This type of game is commonly played by one person, as a game of skill. In FIG. 1 a series of golf tees or pegs 10, 12, 14 are on a board or base 1 which has a series of holes 11, 13, 15, 17, 19, etc. that can accept golf tees or pegs. Pegs 10, 12, 14 occupy holes 11, 17 and 13 respectively. Peg 10 is moved to hole 15, as shown in FIG. 2, while peg 14 is removed from the board, according to the particular rules of this skill game.

Figure 3:
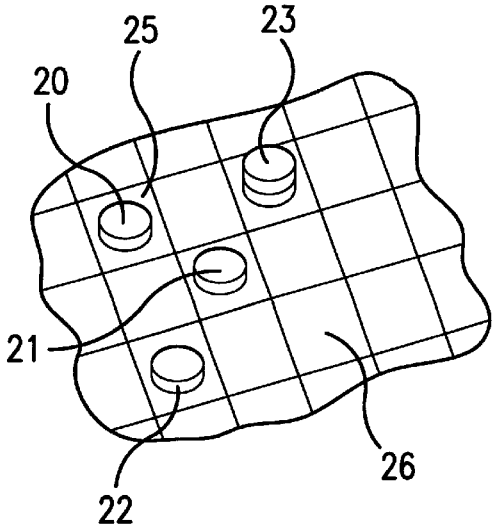
FIG.3 PRIOR ART
FIG. 3 shows a portion of the surface of a prior art checkers type game.
Figure 4:
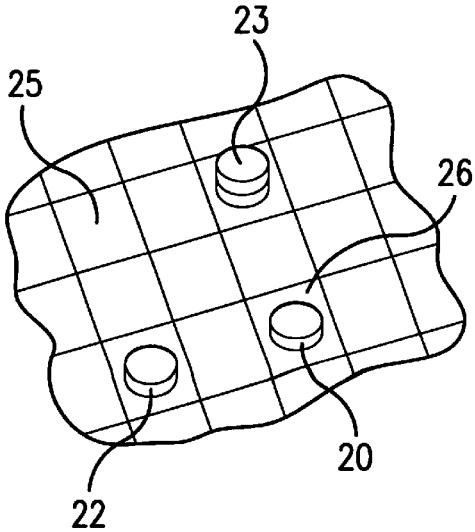
FIG.4 PRIOR ART
FIG. 4 shows the prior art game of FIG. 3 after one move has been made.

FIGS. 3 and 4 show a portion of the surface of the well known checkers game. In FIG. 3 checker pieces 20, 22 and 24 are of one color, while checker piece 21 is of a second color. Checker piece 23 is a "king" and has, as is well known, two checkers, one on top of the other. Checker 20 jumps from square 25 over checker 21 and the result, as shown in FIG. 4, is the removal of checker 21 while checker 20 now occupies occupies square 26.

The problem with the prior art games such as those of FIGS. 1–4 is that pieces are easily lost. When the golf tees or pegs of FIG, 1 or the checkers of FIG. 3 are removed and packed away for another day or a later game quite frequently the pieces are lost. When this happens and there are no extra pieces around other types of pieces, which could be totally different, or of a different color than desirable, are often substituted and the result is not always satisfactory.

Another problem is that while in play pieces are dropped or, in the case of board games such as checkers, the pieces are inadvertently moved. This is frequently the case when such games are played in moving vehicles such as cars or trains. The problem is particularly acute with children who have a remarkable tendency to drop or lose playing pieces.

It would be desirable to have any type of game that normally has removable pieces to have the pieces remain on the game board surface, or in the board itself, permanently, and thus without possibility of loss. The permanent pieces would add a large measure of security and hence satisfaction to the game while still enjoying all of the features the game is known for.

Figure 5:
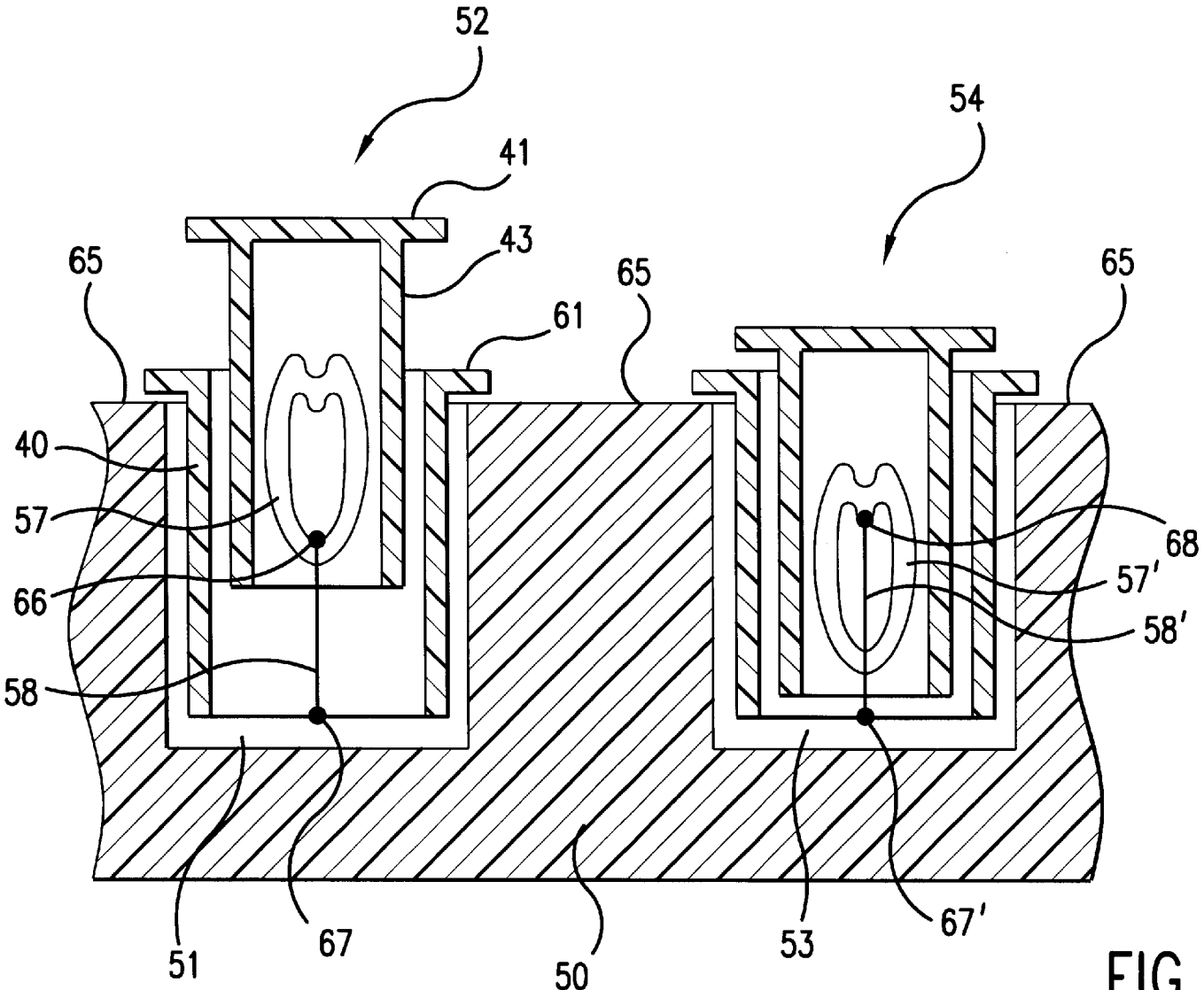
FIG. 5 is a first embodiment of the invention in a partially schematic side view using indicators with square tops.

Reference is now made to FIG. 5 which shows a first embodiment of the invention in a partially schematic side view. FIG. 5 is merely exemplary of the kind of indicator which may be employed. Game board 50, which is made of plastic, has playing pieces or indicators 52 and 54 which extend into recesses 51 and 53, respectively, the recesses shown in exaggerated form. The entire top surface 65 of game board 50 may be considered a first region. Each indicator can be considered a second region, which is of course, smaller than the first region.

Referring to indicator 52 it has a plastic outer housing 40 press fit into recess 51. The depth of the recess permits the longitudinal extent of the housing ingress until a shoulder 41 rests on surface 65. Within housing 40 is plastic inner housing 43 with an undulating path 57 which a U-shaped metal bar 58 traverses. The opposite ends of the bar complete the U shape to engage the path 57 at one end such as at 66, while the other end is fixedly attached by any conventional means, not shown, to the bottom of the housing 40 as at 67. A spring, not shown, maintains the inner housing 43 and thus indicator 52 in the upper position, while the metal bar 58 prevents further upward movement of the inner housing as it engages the lower end at 66. Inner housing 43 moves easily within housing 40 and is constrained to move between an upper position, as shown by indicator 52, by the metal bar 58 engaging the lower end of path 57 at the end 66, and a lower position as shown by indicator 54, where metal bar 58 engages path 57 at the upper end of path 57 at notch 68.

When the indicator is depressed at a position as shown by indicator 52 the bar 58 is caused to follow the right side of path 57 as viewed in FIG. 5 until the bar 58 engages the notch at the upper end of the path 57 as shown at 68 for indicator 54. The notch maintains the indicator in the lower position. When depressed from the lower position, shown for indicator 54, the bar is caused to follow the left side of path 57 while spring action causes the indicator to return to the upper position. Further details of the indicators are not believed necessary as it is of a type that is conventional.

The status of the indicator 52 in an upper position defines an indicator extending upwards from the top surface, as shown by indicator 52, and this can be representative of a playing piece being active or inactive at that region or location. Put another way the indicator upwardly extended shows that that region or area is occupied. With different kinds of housings the indicator may have its top surfaces flush, or even with top surface of the base, or they may be slightly above the surface as shown in FIG. 5 where indicator 54 is shown slightly above the top surface 65. Shoulder 41 of the inner housing rests on the corresponding shoulder 61 of the outer housing. The shoulders rest but are shown in exaggerated form spaced apart for clarity. This lower position with shoulder 61 substantially flush with 65 then represents the opposite meaning, or put another way, the region or area is unoccupied.

The invention uses the push button approach which is defined as the use of an indicator, actuator, switch or piece which is capable of occupying two positions, either an upper or a lower position. It possesses the property of maintaining this position until an affirmative action causes it to occupy the other position. This affirmative action is the depression of the indicator, actuator, switch or piece, by whatever means is available to the player. Most frequently the use of a finger is sufficient. The actuator, indicator, switch or piece thus is effective to cycle between two positions.

The actual indicator is thus a matter of choice and the invention does not rely on the specific illustrated indicator. What is important for whatever indicator is used is that depression once puts it into an opposite position and depressing it again restores it to its original position. In other words, a push button approach is used.

Figure 6:
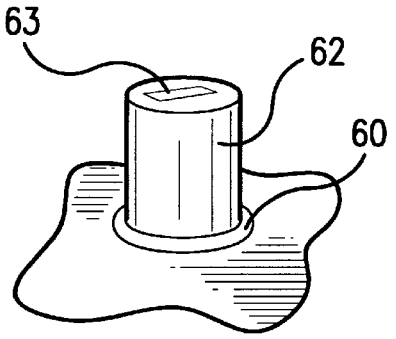
FIG. 6 shows the use of round indicators.

The indicator, push button or piece is, of course, not limited to being square. FIG. 6 shows a round indicator 62 with indicia 63 on the top surface of the indicator, the indicator being in the up position. The recess is shown at 60 in exaggerated size.

Figure 7:
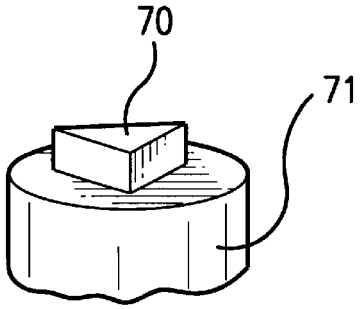
FIG. 7 shows the use of triangular shaped tops for the indicators.
Figure 8:
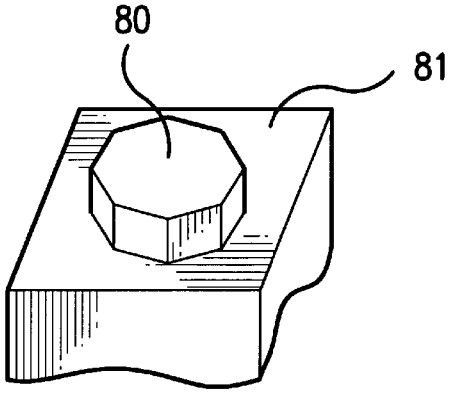
FIG. 8 shows the use of an octagonal shaped top for an indicator.

In FIG. 7 the top of the indicator has a triangular shape 70 while the indicator housing 71 is round. The triangular shape may itself be representative of one player while another shape may be representative of another player, depending on the type of game. FIG. 8 shows an octagonal shape 80 for the top of the indicator while the top of the housing 81 is square shaped. Similarly, the octagonal shape in FIG. 8 may be representative of a player, in other words a type of indicia. It is evident from FIGS. 5–8 that the particular shape of the indicator housing and its top can take many forms.

The indicator may have indicia on it as shown in FIG. 6 or it may be without indicia. The playing piece can be made of a single color or of several colors. In a game such as checkers it is conventional to have red and black checkers. Some push buttons can be made red to represent one player and other push buttons made black to represent another player.

Figure 9:
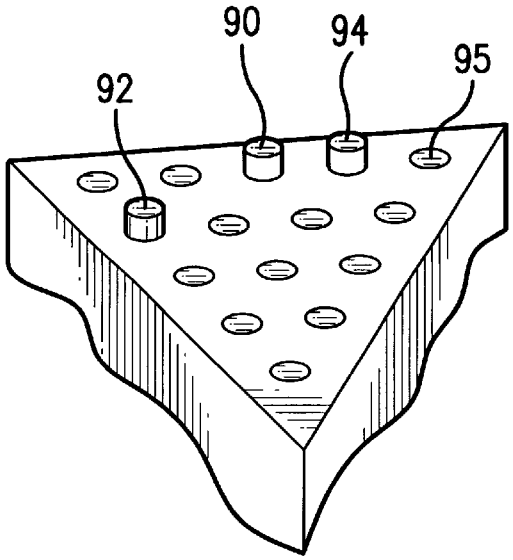
FIG. 9 shows how the inventive indicators are used in a game similar to the golf tee or peg game of prior art FIG. 1 where there is one indicator per region.

FIG. 9 shows how the inventive playing pieces are used to duplicate the situation of a golf tee or peg game similar to that of FIG. 1. Recalling the sequence of play from the FIG. 1 situation, peg 10 jumps over peg 14, is placed in hole 15, and peg 14 is removed from the board. The end of this sequence is shown in FIG. 2 where peg 12 remains and peg 10 is now in hole 15.

Figure 10:
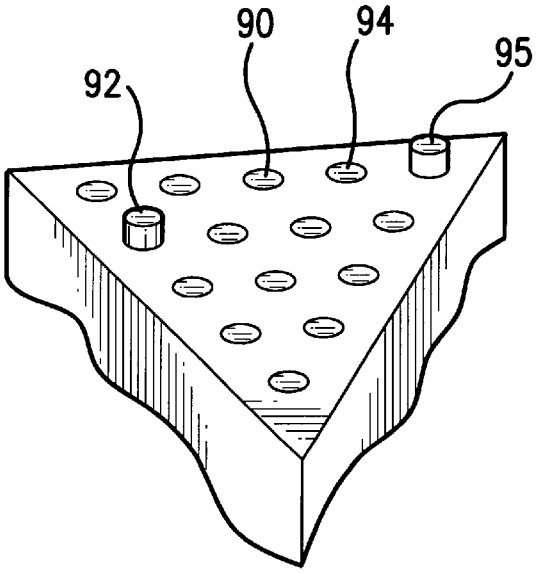
FIG. 10 shows the result after one move has been made in the game of FIG. 9.

This sequence is duplicated in FIGS. 9 and 10. FIG. 9 represents the initial conditions with push buttons 90, 92 and 94 in the up position to indicate they are in play, while all the other push buttons of FIG. 9 are down which indicate their regions are not occupied. This is analogous to FIG. 1 where pegs 10, 12 and 14 are still in play. The recesses are not shown to avoid encumbering the drawing but they are understood to be necessarily present. The down position of the push buttons is analogous to having a hole with no peg in it. Thus the push button arrangement of FIG. 9 represents the identical status shown in the FIG. 1 game using golf tees or pegs.

To simulate the play of FIGS. 1 and 2 and effectively have peg 10 jump over peg 14 and land in hole 15, the push button 90 is depressed once thus "removing" it from its location as shown in FIG. 10. The depression of push button 90 causes it to represent an unoccupied hole. Push button 94 is depressed once to indicate its removal from the board due to the "jump" of piece 90 over it. Finally, push button 95 is depressed once placing it in an up position. Thus "piece" 90 now occupies the region as represented by the push button 95 being in an up position. In effect FIG. 10 represents the identical game conditions to that shown in FIG. 2.

In the FIG. 10 game the push buttons are preferably of the same color since this is a game usually played by only one player. Clearly other games could have different colored push buttons to represent different players, all dependent on the rules of the particular game. Similarly, different colored indicators can be used. The boards may be in various shapes such a Greek cross, where the upright and traverse parts are equal in length and intersect at their middles, or boards may be square, rectangular, circular, octagonal or whatever shape a particular game might require.

The advantage of the inventive push button approach is now evident. Since no playing pieces are ever physically removed from a board or surface they cannot be lost or misplaced. When a game using the inventive push buttons is played in a moving vehicle no pieces are accidentally moved or misplaced. In addition it takes an affirmative action to "make a move". The indicators can't slide accidentally, the push buttons need to be depressed which action is an affirmative action and not an accidental move or touching of the piece.

The games represented thus far in FIGS. 1–4 use a single game peg, piece or indicator. By analogy FIGS. 5–10 show how a single push button in a single region can be used. However the invention is not limited to games simulating singular pegs, indicators or game pieces. For example, more than one indicator in a single region is possible.

Figure 11:
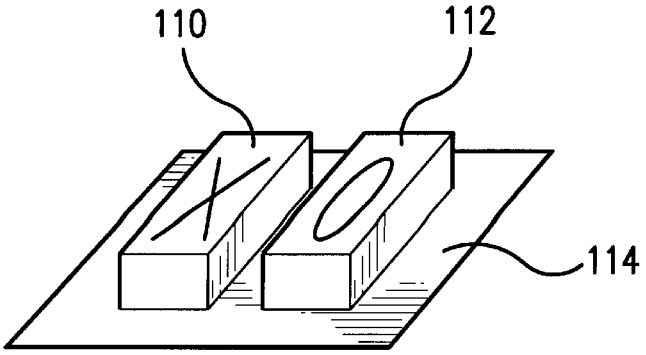
FIG. 11 shows the use of a pair of rectangular indicators in one region.

FIG. 11 is a perspective view of two push buttons occupying a single region. Push button 110 and 112 are both rectangular, both have housing similar to those shown in FIG. 5, and both are within a single region 114, in this example a square region. Push button 110 has identifier ""X"" on its surface while push button 112 has identifier "O" on its surface. The region, or area, 114 is considered a single region or area since it can be "occupied" by either player as represented by indicator 110 or 112. Both push buttons are shown in the up position. Alternatively, one push button could be of a different color from the other or they could be of the same color with indicia on them as shown to distinguish one from the other.

Figure 12:
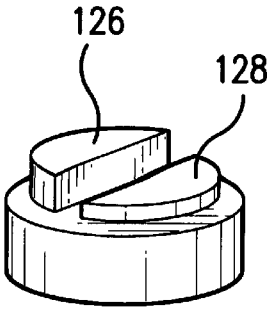
FIG. 12 is similar to FIG. 11 but using a pair of indicators of semi-circular shape in a region.

FIG. 12 shows the result of depressing one push button or indicator of a two push button indicator. In FIG. 12 each push button 126, 128 is in the shape of a semi circle as viewed from the top of the push button. With both push buttons 126, 128 in an up or a down position the region as a circular appearance. As shown in FIG. 12 push button 128 is depressed to place it in the down position. Depending on the type of game, push button 126 may be indicative of being in play while push button 128 is out of play. It could be the other way; push button 126 may be out of play while push button 128 is in play. The use of the push button approach allows flexibility in this regard.

The push button approach can be applied to the familiar game of tic-tac-toe. This game normally uses paper and pencil or the like. As is so often the case the writing on the paper becomes crowded, games are erased, and/or the paper becomes hard to write on or it becomes torn, or quite simply, no pen or pencil is at hand.

Figure 13:
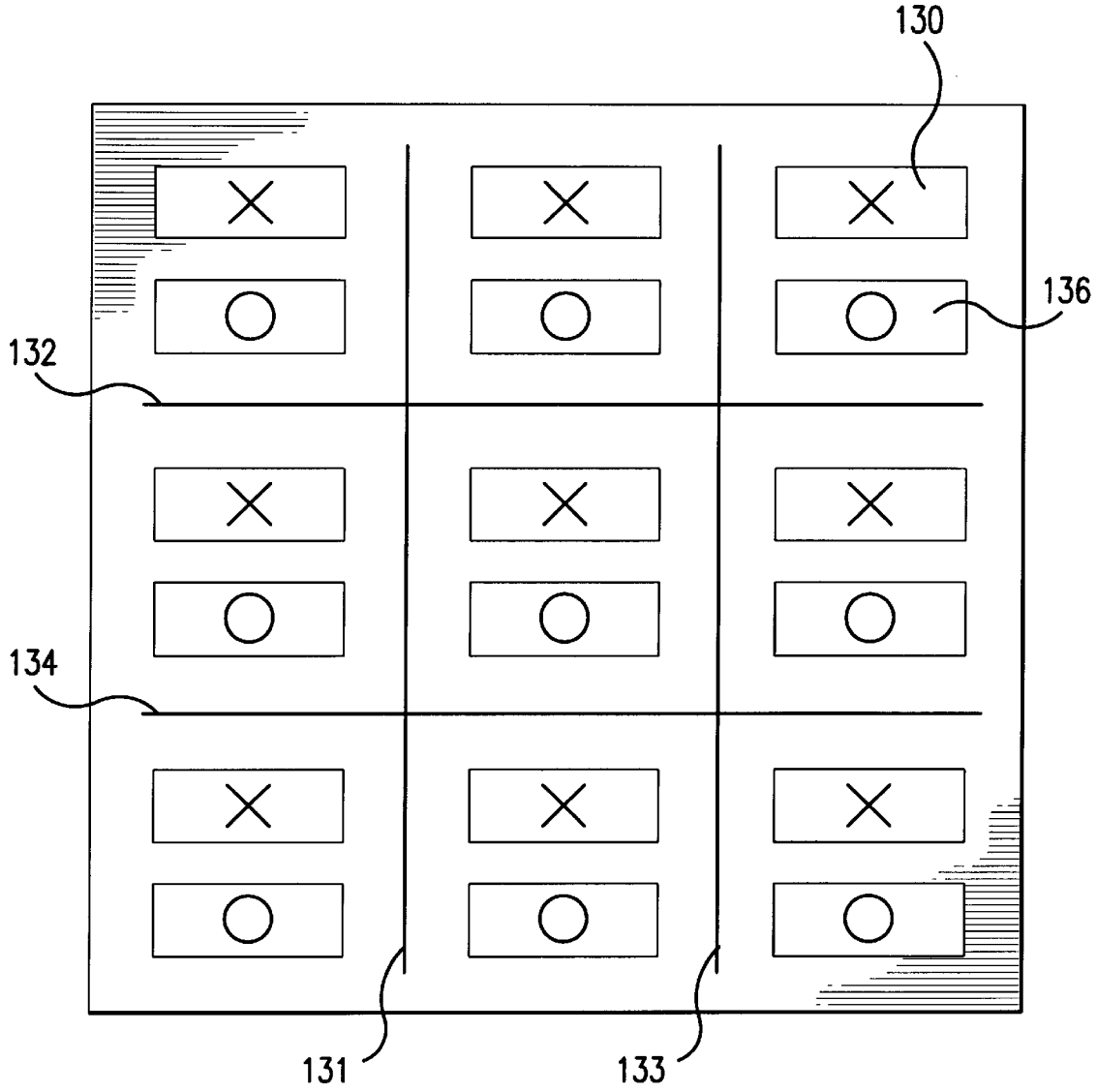
FIG. 13 is a top view using pairs of indicators in a tic-tac-toe game.

FIG. 13 is a top view using the push button approach to the popular game of tic-tac-toe using indicators of the type illustrated in FIG. 11. In FIG. 13 the indicia on the tops of the indicators are the usual ""X"" -s and "O" -s associated with tic-tac-toe. The top of the game board surface has markings thereon in the form of lines 131 through 134 to divide the surface into nine regions;. One of the rectangular push buttons, for example 130, has an ""X"" on the top while the other push button 136 has an "O" on it. The game begins with every push button depressed; in other words the 18 push buttons of FIG. 13 are all depressed. The player who is ""X"" depresses the ""X"" push button to raise it and indicate the presence of ""X"" at that location. On "O" s turn an "O" push button is depressed to raise it and indicate the presence of an "O" at that location or region.

Figure 14:
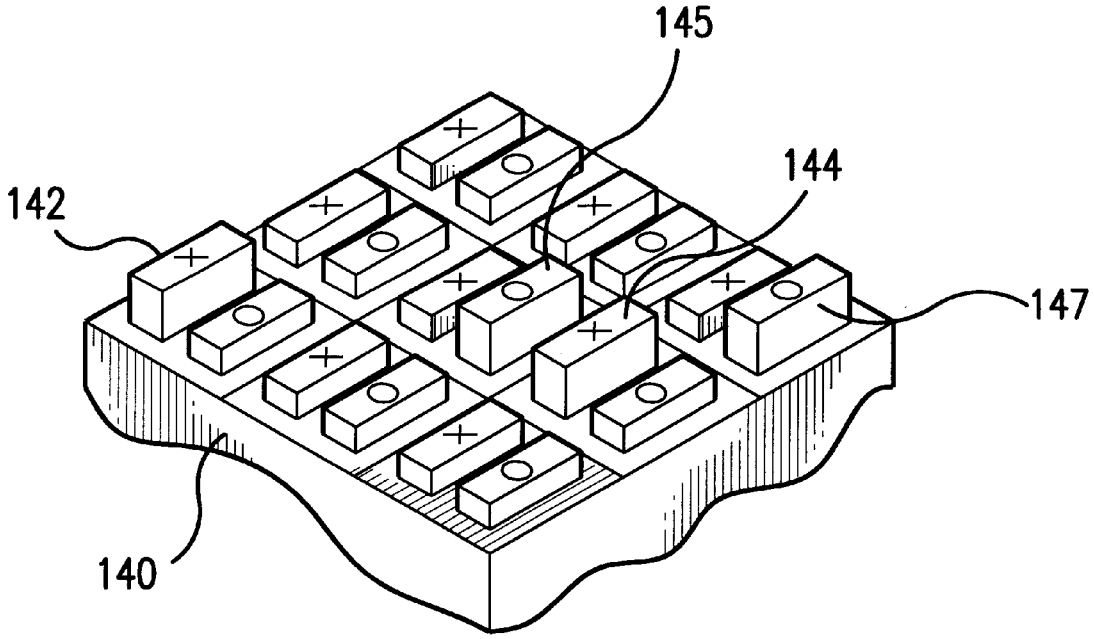
FIG. 14 is a perspective view of a tic-tac-toe game in progress using pairs of indicators.

FIG. 14 illustrates a game of tic-tac-toe at an intermediate stage of the game, it being understood that all 18 push buttons have been depressed once so that they are all in the down position when play begins. Each of the "X" and "O" players have made two moves. Thus, push buttons 142, 144 for the "X" player have been depressed once since the start of the game, and push buttons 145, 147 have been depressed once since the start of the game. The result after two moves by each side is depicted in FIG. 14. For illustrative purposes the remaining push buttons are shown higher than the top of the base 140. The push buttons could, of course, be level with the playing surface. The exact height of the push buttons above the surface of the playing field depends on many factors, including but not limited to, the type of push button or its length when depressed.

The exact type of game will dictate the number of push buttons needed for a region. One push button in a single region would suffice for a game analogous to the golf tee or peg board game such as shown in FIGS. 1 and 2 and as represented in FIGS. 9 and 10, and two push buttons per region would suffice for the tic-tac-toe game of FIG. 14. However, there may be a need for three or four or more push buttons per region, depending on the game.

Figure 15:
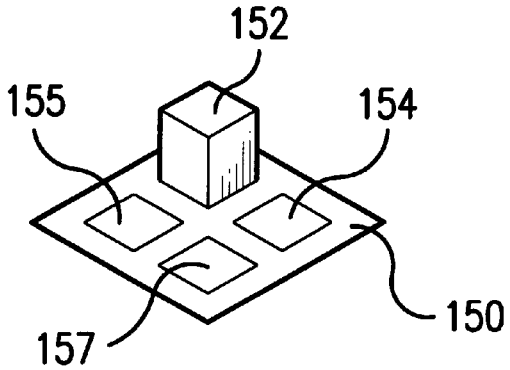
FIG. 15 shows the use of two pairs of indicators in a region.

FIG. 15 is a perspective view of part of a playing surface having a region with four push buttons. Region 150 is part of an overall playing surface and has two pairs of push buttons in it. Push button 152 is in the up position to indicate it occupies the region 150. Push buttons 152, 154 form one pair, for example, colored red, while the pair 155, 157 could be colored black. Any other color choices would be acceptable since the main purpose is to distinguish one indicator or player from another indicator or player.

Figure 16:
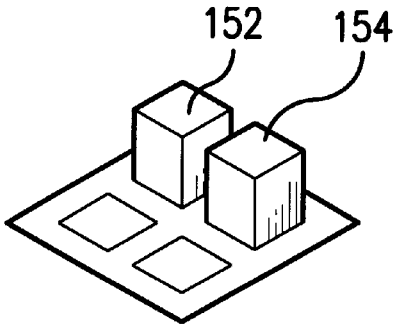
FIG. 16 is similar to FIG. 15 where both indicators of one pair are in an up position.

The checkers game conventionally has red and black pieces. In an analogous fashion two of the push buttons 152, 154 could be red, while the other two push buttons 155, 157 could be black. When one push button is in the up position as shown in FIG. 15 this means that a red piece occupies the position. When both pairs, for example, 152 and 154, are in the up position as shown in FIG. 16 this represents a red "king". If the push button 155 is up this indicates a black piece occupies the position, while if both 155, 157 are up this indicates a black "king" occupies the position.

The game of checkers is a good example of a game requiring four push buttons in a region. The conventional approach to the checkers game uses checker pieces and from time to time a checkers piece may need to be "kinged". Because of the occasional need to "king" the push button approach to checkers requires four push buttons.

Figure 17:
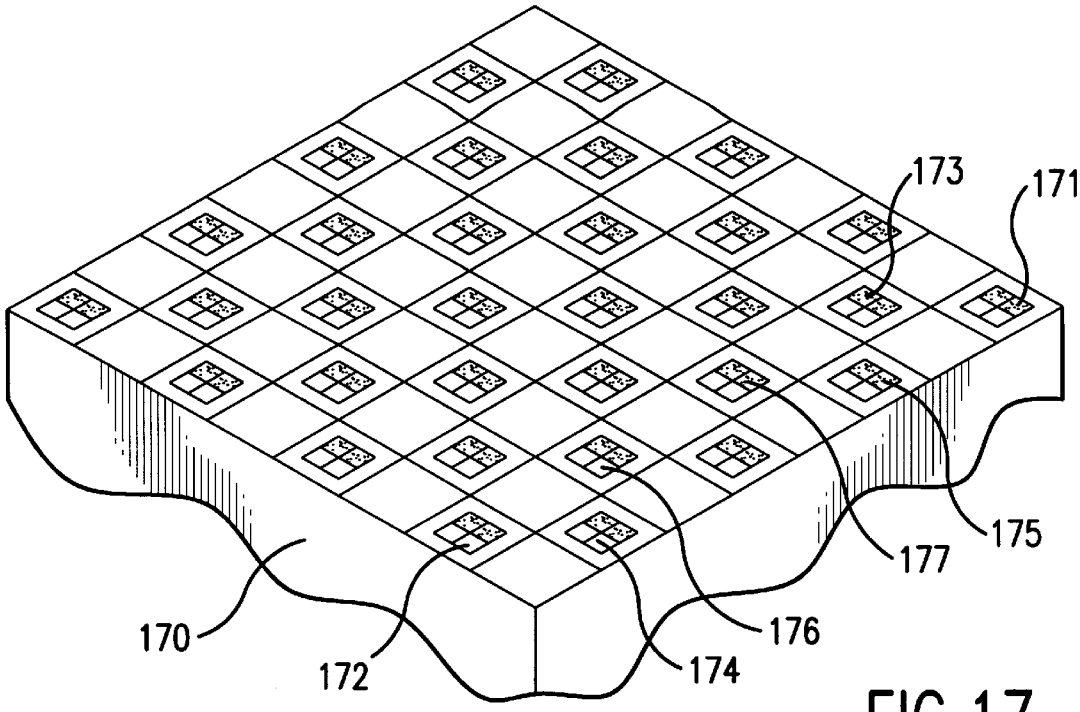
FIG. 17 is a perspective view using indicators in a checkers type game.

FIG. 17 is a perspective view of a checkers game using the push button approach. Game board 170 may have the common checkerboard pattern on its top surface, or may be lined into 64 squares as shown in FIG. 17.

At the start of play only the beginning pieces are in play and they are in their starting regions. The starting regions for one player are represented by regions 172, 174, 176; the remaining squares to the left of these regions as viewed in FIG. 17 could, with indicators 172, 174, 176 represent the black pieces, and in each pair on the black side only one push button in the starting regions is up. Similarly on the red side of the board are starting regions 171, 173, 175 and, with the remaining regions to the left of these regions, represent the red pieces, and likewise, in each pair on the red side only one push button is up. The eight regions in the middle of the board are initially neutral and hence of their push buttons are down. Thus at the beginning of play out of a total of 32 regions with indicators in them, 12 black push buttons are up and 12 red push buttons are up.

As play progresses, in order to move red from region or position 175 to region or position 177, one red push button at 177 is depressed to represent an occupied position and the red push button at 175 that was initially up is depressed to its down position. Should red advance far enough to be "kinged", say to a region or position 172 then both of the red push buttons at region 172 would be depressed once to raise both to the up position.

Figure 18:
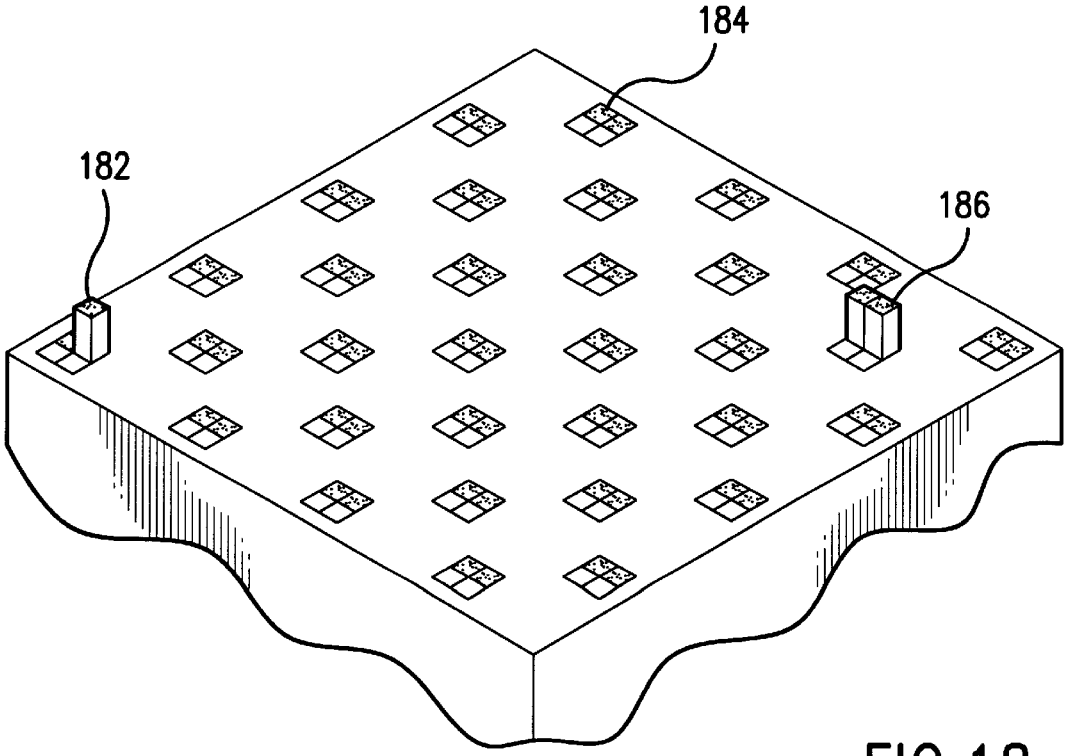
FIG. 18 is another perspective view of a checkers type game in progress.

FIG. 17 illustrates a checkerboard pattern with lines dividing the surface into squares but the invention is not limited to a lined pattern on the surface. FIG. 18 shows a checkers type game using push buttons without any lines on the playing surface. Because there are no pieces to move or get lost or misplaced the FIG. 18 embodiment offers versatility to the old checkerboard pattern. FIG. 18 has no lines or squares drawn on the surface but the effect of the 32 push buttons is as clear as a lined pattern and is a dramatic departure from the usual checkerboard pattern. In FIG. 18 one push button 182 is shown in the up position to represent a normal piece occupies the square. A space is unoccupied as shown at 184 when all four push buttons are down. When two push buttons for the same player are up as shown at 186 then a "king" occupies the region.

Figure 19:
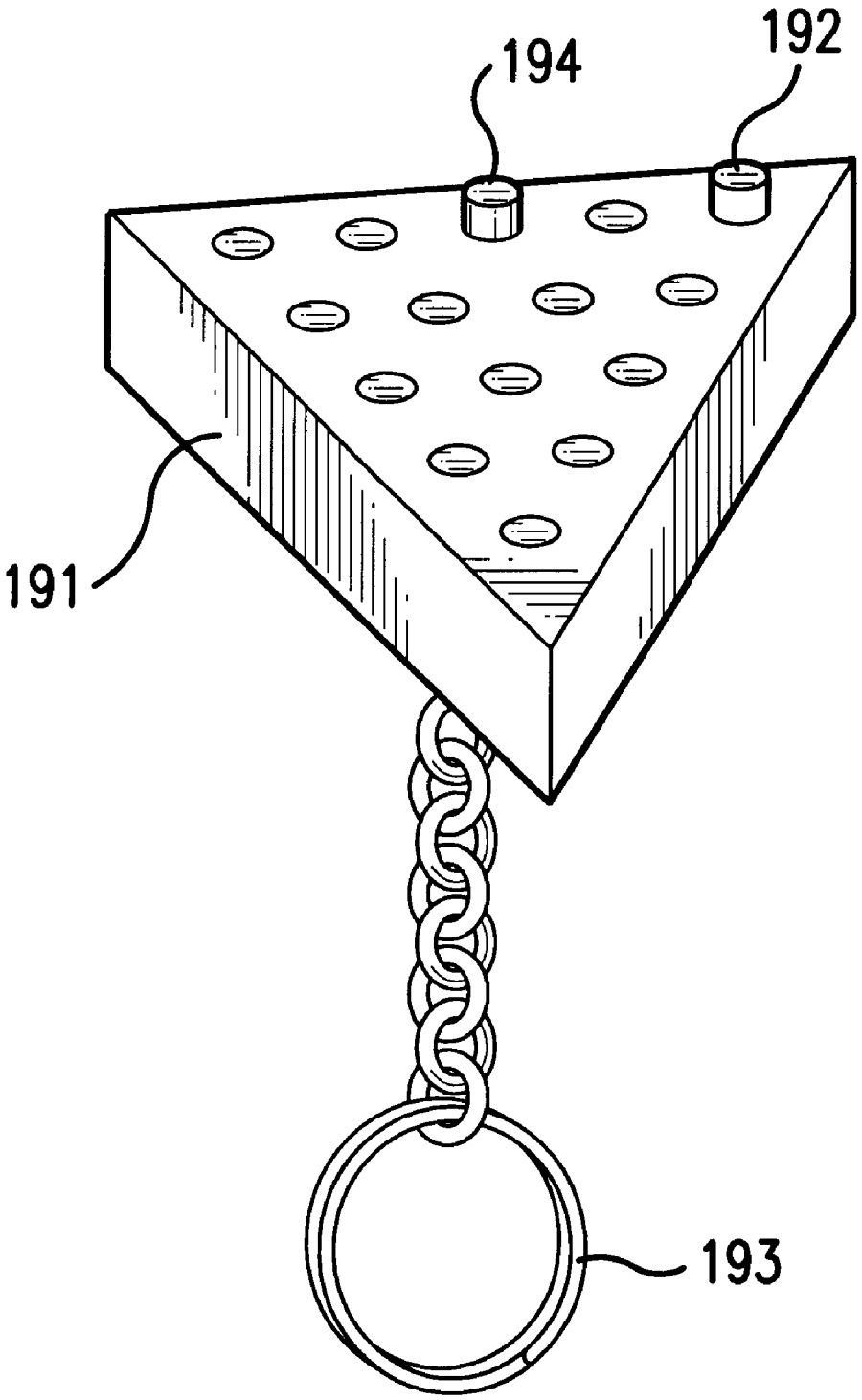
FIG. 19 is a perspective view of a game with a key chain attached.

FIG. 19 is a further illustration of a golf tee or peg like game using the push button approach. FIG. 19 shows 15 push buttons within base 191, with only push buttons 192, 194 shown in the up position. The game of FIG. 19 has an attachment means connected to the base 191 in the form of a key chain 193 attached to the base 191 to illustrate the invention may be made quite small. Clearly most games can be made smaller but with smaller games come smaller pieces. The disadvantage with small pieces is that they become hard to handle. Very young children, older persons, and the infirmed find small pieces particularly hard to move, and when they fall they are extremely difficult to find. The push button approach has advantages here in that there are no pieces to move or drop, and if made small enough the push buttons can be depressed with a pen, pencil, pin or other object or, depending on the size of the game board and indicators, with a finger.

The type of game that may be played using the push buttons is a matter of choice although the type of game most likely to benefit from the push button approach would be those where pieces are easily lost or misplaced and those where movement causes inadvertent movement of a piece. Each of these disadvantages are avoided with the teachings of the present invention. The housings and base are advantageously made of plastic although it will be recognized any suitable materials may be used as appropriate.

I claim:

1. A game board comprising:

a base member with a top surface;

said top surface defining a first region;

said top surface further having a plurality of second regions, each of said second regions smaller than said first region;

each of said second regions having at least a first indicator which extends at least partially into at least a first recess;

said at least first indicator capable of being in two positions;

one of said two positions being an upper position, the other of said two positions being a lower position;

said first position extending from said top surface to an upper position;

said second position being a lower position than said upper position;

said at least one indicator being depressible when in said upper or said lower position; whereby said indicator when in said upper position can be depressed to attain said lower position, and said indicator when in said lower position can be depressed to attain said upper position.

2. The game board of claim 1 wherein said lower position is substantially flush with said top surface.

3. The game board of claim 1 wherein said top surface is in the shape of a triangle.

4. The game board of claim 1 wherein said top surface is in the shape of a square.

5. The game board of claim 1 wherein each of said second regions has at least two indicators.

6. The game board of claim 5 wherein said top surface has markings thereon to divide said top surface into nine regions.

7. The game board of claim 3 wherein said top surface is divided into fifteen regions.

8. The game board of claim 1 wherein said top surface is divided into thirty two regions.

9. The game board of claim 1 wherein each of said second regions has at least four indicators.

10. The game board of claim 8 wherein each of said second regions has at least four indicators.

11. The game board of claim 1 wherein said base has an attachment means connected to said base.

12. The game board of claim 1 wherein said top surface has markings thereon to divide said top surface into said plurality of second regions.

* * * * *